US006443478B1

(12) United States Patent
Keller et al.

(10) Patent No.: US 6,443,478 B1
(45) **Date of Patent: *Sep. 3, 2002**

(54) BINDING/BOOT COMBINATION FOR SNOWBOARDS OR THE LIKE

(75) Inventors: Alexander Keller, Unterammergau; Edwin Lehner, Farchant; Werner Messerschmidt, Garmisch-Partenkirchen, all of (DE)

(73) Assignee: Marker Deutschland GmbH, Eschenlohe (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/690,857

(22) Filed: Aug. 1, 1996

(30) Foreign Application Priority Data

| | | |
|---|---|---|
| Aug. 2, 1995 | (DE) | 195 28 194 |
| Dec. 19, 1995 | (DE) | 195 47 329 |
| Feb. 2, 1996 | (DE) | 296 01 682 U |

(51) Int. Cl.[7] ..... A63C 9/20
(52) U.S. Cl. ..... 280/624; 280/627
(58) Field of Search ..... 280/7.13, 623, 280/613, 624, 625, 627, 633, 634, 637, 14.21, 14.22, 14.24; 36/117.1, 117.3

(56) References Cited

U.S. PATENT DOCUMENTS

| | | | | |
|---|---|---|---|---|
| RE26,972 E | * | 10/1970 | Spademan | 280/624 |
| 3,730,543 A | * | 5/1973 | Edmund | 280/623 |
| 3,893,682 A | * | 7/1975 | Weinstein et al. | 280/637 |
| 3,936,065 A | * | 2/1976 | Ramillon | 280/633 |
| 4,021,056 A | * | 5/1977 | Oakes | 280/613 |
| 4,142,735 A | * | 3/1979 | Biermann et al. | 280/637 |
| 4,808,134 A | * | 2/1989 | Imbeault | 36/117.3 |
| 4,973,073 A | | 11/1990 | Raines et al. | 280/624 |
| 5,362,087 A | * | 11/1994 | Agid | 280/14.2 |
| 5,474,322 A | * | 12/1995 | Perkins et al. | 280/623 |
| 5,520,406 A | * | 5/1996 | Anderson et al. | 280/14.2 |
| 5,595,396 A | * | 1/1997 | Bourdeau | 280/613 |
| 5,690,351 A | * | 11/1997 | Karol | 280/14.2 |
| 5,695,210 A | * | 12/1997 | Goss et al. | 280/14.2 |
| 5,713,594 A | * | 2/1998 | Jenni | 280/14.2 |

FOREIGN PATENT DOCUMENTS

| | | | | |
|---|---|---|---|---|
| DE | 4020873 | * | 1/1992 | 280/14.2 |
| WO | WO94/16784 | | 8/1994 | |

* cited by examiner

*Primary Examiner*—Frank Vanaman
(74) *Attorney, Agent, or Firm*—D. Peter Hochberg; Katherine R. Vieyra; William H. Holt

(57) ABSTRACT

A binding for a snowboard or the like and a boot sole for cooperating with the binding, the sole having side engagement members, and the binding having a stationary boot-retaining member and a movable boot-retaining member having a latched condition for engaging the side engagement members, and a release condition for not engaging the side engagement members. The movable boot-retaining member can be automatically or voluntarily placed in the latched condition.

24 Claims, 7 Drawing Sheets

BINDING/BOOT COMBINATION FOR SNOWBOARDS OR THE LIKE

BACKGROUND OF THE INVENTION

1. Field of the Invention

The invention relates to a binding/boot combination for snowboards or the like, having boot-retaining devices which are arranged on the snowboard or the like or on parts connected thereto. More particularly, the invention relates to bindings which act in the region of the center of the boot on the longitudinal sides of the sole or on boot side parts connected thereto, and, when the boot is introduced into the binding, the binding can be changed over automatically or voluntarily from a release position into a latched or closed position.

2. Description of the Prior Art

A binding/boot combination of this type forms the subject matter for U.S. Pat. No. 4,973,073. In this patent, a long, wide and rigid plate part is arranged on the sole in the central foot region of the boot. The plate part has a U-shaped cross section, with the lowermost portion extending in the longitudinal direction of a received boot. Flaps or webs located on lateral longitudinal edges of the plate part, engage a stationary boot-retaining part of the binding on one side of the boot, and interact with a boot-retaining part of the binding on the other side of the boot. The binding can be converted between a latched position and a release position. When the boot is introduced into the binding, the binding can be pressed down into the latched position from its release position. On account of its large dimensions in the longitudinal and transverse directions of the boot, the plate part causes the boot to be very stiff. Furthermore, the lateral overhang of the plate part hinders the snowboarder when walking with the plate part attached to the boot.

A further binding/boot combination of the type specified in the introduction is known from International Patent Application Publication No. WP 94/16784. A comparatively small plate part is discussed in this publication which is arranged on the sole in the central foot region of the boot. The plate part has an essentially rectangular shape and interacts with boot-retaining parts of the binding by means of shorter edges, which extend in the longitudinal direction of the boot. On account of the small place where the boot is anchored on the binding, the boot must have a comparatively rigid shell.

DE-U 94 133 356 discloses a binding/boot combination in which the binding grips the boot in the heel region by means of two lateral pivot hooks whose ends are designed in the manner of latching lugs and engage into lateral depressions on the heel region. Arranged in the toe region or in the region of the ball of the foot of the boot sole is a transverse flange which is pushed into a fixed hook-shaped securing device of the binding when the snowboarder introduces the boot into the binding. The securing device of the front region of the boot is intended, on the one hand, to increase the fastenings base of the boot in the binding. On the other hand, it predetermines the desired position of the heel-side depressions relative to the pivot hooks when the boot is introduced into the binding.

SUMMARY OF THE INVENTION

An object of the invention is to provide an improved binding/boot combination for attaching a boot to a snowboard or the like.

Another object is to provide a binding/boot combination enabling various designs of the boot sole.

Yet another object is to provide snowboard bindings capable of arranging boots mounted on a snowboard.

It is yet another object of the invention to provide a binding for snowboards which can be used with unconventional snowboarding practices, but which is still usable with comfortable boots.

An additional object of the present invention is to provide an improved binding for a snowboard or the like which can be practiced in an efficient and economical manner.

These objects are achieved according to the preferred embodiment of the invention with a boot-retaining device which interacts at positions of a central boot section which are symmetrical with respect to a transverse axis and a longitudinal axis of the boot sole, with the longitudinal sides of the boot sole or the side parts. A profile or tactile engagement surface on the underside of the boot sole engages with a mating profile or tactile location surface on the upper side of the snowboard or the like or of a part associated therewith, e.g., a base plate of the binding, the side parts and the boot-retaining devices which interact therewith as well as the profile and the mating profile preferably being designed such that the boot can be retained in the binding both in the forward direction and in the backward direction.

The invention is particularly directed to young snowboarders who try clever snowboarding techniques with bindings according to the invention which, in its preferred form, is particularly suitable for unconventional snowboarding practices, but which binding can be used in combination with comfortable boots. Since the boot is positively locked in connection with the snowboard and cannot move in the region of the ball of the foot and in the heel region, because of the mating profiles of the sole and snowboard in the region of the ball of the foot and the heel, firm securing with respect to the vertical axis of the snowboard or of the tibia axis of the snowboarder is achieved even if there is only a narrow base for the boot-retaining devices, which act in the central region of the boot. Furthermore, the boot is of a soft and flexible design.

Moreover, the binding according to the preferred form of the invention provides the advantage that operating elements of the binding, e.g., unlocking levers or other hand-operated parts, may be arranged on either side of the boot, depending on the wishes of the snowboarder. For this purpose, all that is required is for the respective binding to be turned through 180° with respect to the vertical axis, i.e., to be mounted in the "backward direction" rather than in the "forward direction."

According to a particularly preferred embodiment of the invention, a dimensionally stable or rigid fitted piece is arranged on the boot sole or can be fitted thereon or can be embedded in the boot sole, which fitted piece can be introduced between the boot-retaining devices from above and has the side parts which interact with the boot-retaining devices.

In this arrangement, it is preferably provided that the outside of the side parts are at a transverse spacing from one another which corresponds approximately to the sole width. The side parts have a longitudinal border, over which a boot-retaining device of the binding is engageable. An opening is provided inside the longitudinal border which connects the upper side and underside of the longitudinal border and whose cross section is dimensioned such that, when a boot is introduced into the binding or when the binding is closed, a layer of snow or ice which has formed above the longitudinal border can be forced away, by way of the boot-retaining device, downward through the opening, in the direction of a free space provided there in the binding.

The fitted piece makes many designs of the boot possible, especially with regard to its flexibility. Since the fitted piece is arranged in the central foot region, there is no comfort lost, because the stiffening in the sole caused by the fitted piece virtually cannot be felt at all in the central foot region. At the same time, particularly secure fixing of the boot in the binding is ensured, especially with respect to the longitudinal direction of the boot and in the vertical direction.

If appropriate, the fitted piece may also be part of an adapter or an overboot to which basically any design of boot can be used, or a very flexible inner boot can be connected or accommodated and thus introduced into the binding.

BRIEF DESCRIPTIONS OF THE DRAWINGS

Moreover, with regard to the preferred features of the invention, reference is made to the claims and to the following explanation of the drawing with reference to which the particularly preferred embodiments are described:

DETAILED DESCRIPTION OF THE PREFERRED EMBODIMENTS

Figure 1:
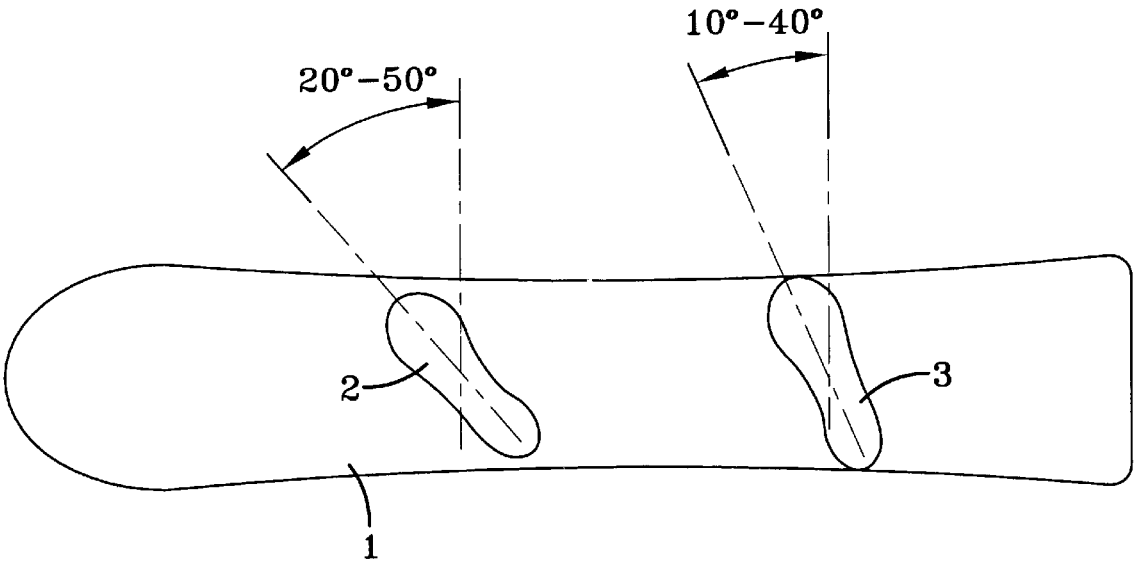
FIG. 1 shows a schematic plan view of a snowboard with examples of positions for the feet of the snowboarder.

Referring to FIG. 1, a pair of positions for the front and the rear feet of a snowboarder are represented by way of example at numerals 2 and 3 on a snowboard 1. The snowboarder usually stands on the snowboard 1 with his/her two feet oblique with respect to the longitudinal direction of the snowboard 1. In this arrangement, the front foot in position 2 usually forms an angle of between 20° and 50° with respect to the transverse direction of the snowboard 1, while the rear foot is at an angle of between 10° and 40° relative to the transverse direction of the snowboard 1.

Depending on the snowboarding style or shape of the snowboard 1, other positions 2 and 3 may also be provided. In particular, it is also possible for both feet to be retained precisely or approximately in the transverse direction of the snowboard 1.

The snowboard bindings according to the preferred embodiments of the invention are designed such that they provide virtually as much choice of selection as possible with respect to the positions 2 and 3.

Figure 2:
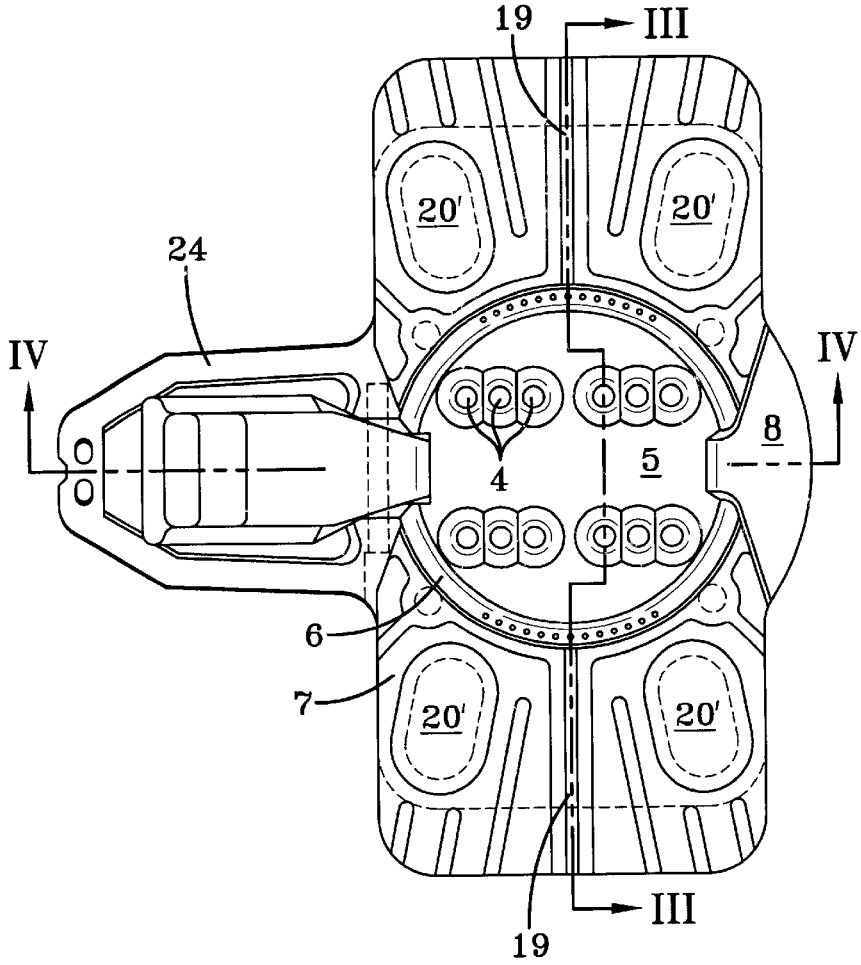
FIG. 2 shows a plan view of a binding according to the invention.
Figure 3:
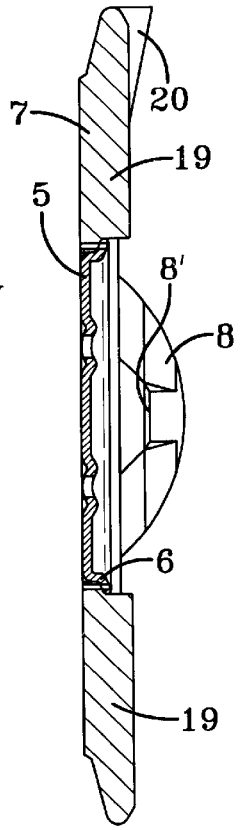
FIG. 3 shows a section along the section line III—III in FIG. 2.

Referring to FIGS. 2 and 3, a binding for each foot has a circular disk 5 which is retained releasably on the upper side of the snowboard 1, e.g., by means of a plurality of screws 4. A circumferential edge of disk 5 has a collar 6 which is spaced apart from the upper side of the snowboard 1.

The disk 5 is arranged in a correspondingly circular cutout or opening of a base plate 7, against which the collar 6 is disposed. Collar 6 overlaps the edge of the circular cutout of the base plate 7 from above, against the upper side of the snowboard 1 when the screws 4 which retain the disk 5 are tightened to a sufficient extent.

The mutually facing sides of the collar 6 and of the base plate 7 may be provided with mating toothing arrangements or the like, to result in the base plate 7 being secured in a positively and frictionally locking manner. The toothing arrangement is intended to have a comparatively narrow pitch, in order to be able to ensure that the base plate 7 can be retained at virtually any angle relative to the longitudinal axis and transverse axis of the snowboard 1.

The toothing arrangement may be provided on the outer circumference of the collar and interact with a mating toothing arrangement on the upper side of the base plate 7.

Figure 4:
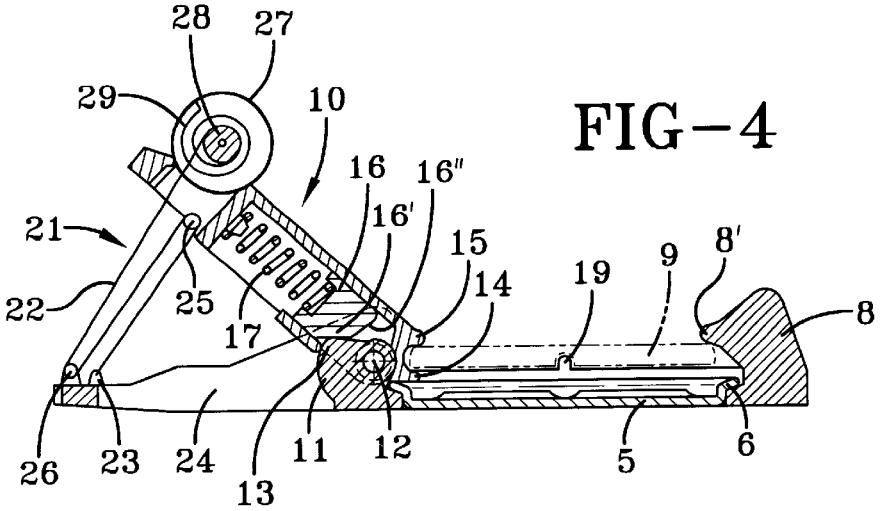
FIG. 4 shows a section along the section line IV—IV in FIG. 2.

Turning next to FIG. 4, as well as to FIGS. 2 and 3, arranged on one longitudinal side of the base plate 7 is a sole-retaining device 8 which is stationary with respect to the base plate 7 and is designed such that it engages over a lateral longitudinal edge of a sole 9 of a boot of the snowboarder from the side, more or less, causing wedging between the boot-retaining device 8 and sole 9 being made possible by the oblique arrangement, which can be seen from FIG. 4. Surface 8'of sole-retaining device 9 extends over and engages the sole 9.

A movable sole-retaining device 10 is arranged on that longitudinal side of the base plate 7 which is located opposite the sole-retaining device 8. For this purpose, the base plate 7 has fastened or integrally formed on it a bearing block 11 on which the sole-retaining device 10 is mounted such that it can be pivoted about a bearing pin 12 parallel to the longitudinal direction of the base plate 7 or of the sole 9. On the side remote from the sole-retaining device 8, bearing block 11 has a cam-like protrusion 13, the function of which is explained below.

The sole-retaining device 10 is designed in the manner of a double-armed lever, the lever arm which is remote from the sole-retaining device 9 being comparatively long and the lever arm which faces the sole-retaining device 8 being of comparatively short dimension. The latter, short lever arm has a tread spur 14 which interacts with the underside of the boot sole 9 and, when the boot sole is introduced between the sole-retaining devices 8 and 10, is pressed down against the upper side of the snowboard 1 or of the base plate 7, the sole-retaining device 10 pivoting into the use position represented in FIG. 4 and engaging over the facing side edge of the boot sole 9 by means of a hold-down device 15.

The long lever arm, remote from the sole-retaining device 8, of the sole-retaining device 10 has an essentially tubular region within which a piston 16 is guided in a displaceable manner, this position being held under stress by means of a helical compression spring 17 which is supported on an abutment in the longer lever arm of the sole-retaining device 10, against the cam-like protrusion 13 of the bearing block 11. That end side of the piston 16 which faces the protrusion 13 has, on the one hand, an oblique surface 16' which interacts with the cam-like protrusion 13, under the pressure of the helical compression spring 17, such that a pronounced torque is exerted on the sole-retaining device 10 in the clockwise direction as soon as the oblique surface 16' comes to bear against the protrusion 13. The torque is so pronounced that the edge of the boot sole 9 which is gripped by the holding-down device 15 is held with very high force against the base plate 7.

On the other hand, the above-mentioned end side of the piston 16 has a latching recess 16" which adjoins the oblique surface 16' and into which the cam-like protrusion 13 of the bearing block 11 engages when the sole-retaining device 10 is pivoted, in the counterclockwise direction, from the position represented in FIG. 4 until the longer lever arm has approached the upper side of the snowboard 1.

The latching recess 16" is dimensioned such that the latching forces which occur remain limited and the tread spur 14 can be pressed down by the boot sole 9, the oblique surface 16' then being forced, on account of the associated pivoting of the sole-retaining device 10 in the clockwise direction, to slide onto the protrusion 13 of the bearing block 11, and the sole-retaining device 10 being pivoted automatically into the position of FIG. 4.

The stressing of the spring 17 and the angle of the oblique arrangement of the oblique surface 16' are dimensioned such that the holding-down device 15 is held with very high force, from above, against the adjacent edge of the boot sole. This thus ensures, on the one hand, that the boot sole 9 is pushed with corresponding force against the upper side of the snowboard 1, the boot sole being made to approach the upper side of the snowboard if a relatively thick layer of snow should adhere beneath the boot sole when the boot is first introduced into the binding, with the layer of snow then being forced away or melted over time. In this arrangement, reliable securing can thus be achieved even in the case of relatively thick layers of snow. Reliable securing according to the invention is effected even if a comparatively large snow spanning height occurs. On the other hand, it is ensured that the ski boot cannot become released from the snowboard 1 even in the event of a fall. Such behavior is required and desired in a snowboard binding—as opposed to a ski binding. However, should it be desired to release the boot, this can be achieved by a slightly modified arrangement of the oblique surface 16', i.e. in the representation of FIG. 4, the angle formed by the oblique surface 16' with the longitudinal axis of the piston 16 could deviate from a right angle to a less pronounced extent.

In order to ensure a particularly rigid connection between boot or sole 9 and the snowboard 1, in particular also as regards the transmission of torques with respect to a vertical axis of the snowboard 1, the parts of the sole 9 which interact with the sole-retaining device 8 and the hold-down device 15 may be designed on the border or edge of the boot sole 9 in the manner of a cutout which is opened toward the top and toward the respective longitudinal side of the boot.

In addition or as an alternative, the boot underside may be configured or have a profile or tactile engagement surface which engages a corresponding mating profile or tactile locating surface on the upper side of the respective base plate 7.

In the example of FIGS. 2 to 4, the upper side of the base plate 7 has arranged on it a longitudinal rib 19 which is received in a mating longitudinal groove on the underside of the sole 9. On the one hand, this ensures a connection between the boot and snowboard 1 which is rotationally rigid with respect to the vertical axis of the snowboard 1. On the other hand, the longitudinal rib 19 and the longitudinal groove of the sole 9 interact as an aid in inserting a boot in the binding, i.e. the boot is virtually forced into the desired position when it is introduced into the binding.

According to a preferred embodiment of the invention, wedge-shaped underlay piece 20, as shown in FIG. 3, may be arranged at the end portions of the base plate 7 in order to support the boot in the toe and/or heel region, in an elevated position with respect to the upper side of the snowboard 1 or the upper side of the base plate 7.

Instead of the wedge-shaped design, the underlay pieces 20 may also be designed in the manner of pins 20', preferably those with a large-surface-area head, and may be arranged in different, selectable ways in prepared cutouts of the base plate 7, as shown for example in FIG. 2.

In principle, the long lever arm of the sole-retaining device 8 is suitable as a handle by means of which the sole-retaining device 10 can be pivoted and changed over into the release position from the clamped-in position of FIG. 3.

According to a particularly preferred embodiment, a cable pull 21, which is only represented schematically in FIG. 4, is provided for this purpose. The cable pull is designed, in the example represented, in the manner of a block and tackle. In this arrangement, a cable 22 is fastened on an abutment 23 which is arranged on a lateral continuation 24 of the base plate 7. From said abutment 23, the cable 22 runs over a roller 25, which is arranged in the vicinity of the free end of the larger lever arm of the sole-retaining device 10, and from there over a roller 26, which is arranged on the continuation 24, and from there through an eyelet at the free end of the larger lever arm of the sole-retaining device 10 to, for example, a spherical grip piece 27. Arranged within the grip piece 27 is a reel 28 which is fixed to the cable 22 and is subjected to a limited torque, for example, by a helical spring 29, such that the reel 28 tries to wind up excess cable 22 with a relatively low force and tries to bring the grip piece 27 to bear against the longer lever arm of the sole-retaining device 10.

When the grip piece 27 is then gripped by one hand and drawn vertically upwardly, that section of the cable 22 which is wound up on the reel 28 is first unwound and then, when the grip piece 27 is drawn further in the upward direction, the sole-retaining device 10 in FIG. 4 pivots in the counterclockwise direction against the continuation 24 of the base plate 7; the position of the sole-retaining device 10 in which the latter is near to the continuation 24 is secured by the latching recess 16" of the piston 16 interacting with the cam-like protrusion 13. If the grip piece 27 is then let go, the entire excess cable 27 is then wound up again, the grip piece 27 resting resiliently against the sole-retaining device 10.

If the boot is subsequently introduced into the binding, the tread spur 14 is pressed down by the sole 9, and the sole-retaining device 10 can then pivot in the clockwise direction into the clamped-in position of FIG. 3. A length of the cable 22 which is sufficient for the pivot movement of the sole-retaining device 10 is again released and is unwound from the reel 28, on account of the low force of the spring 29.

Figure 5:
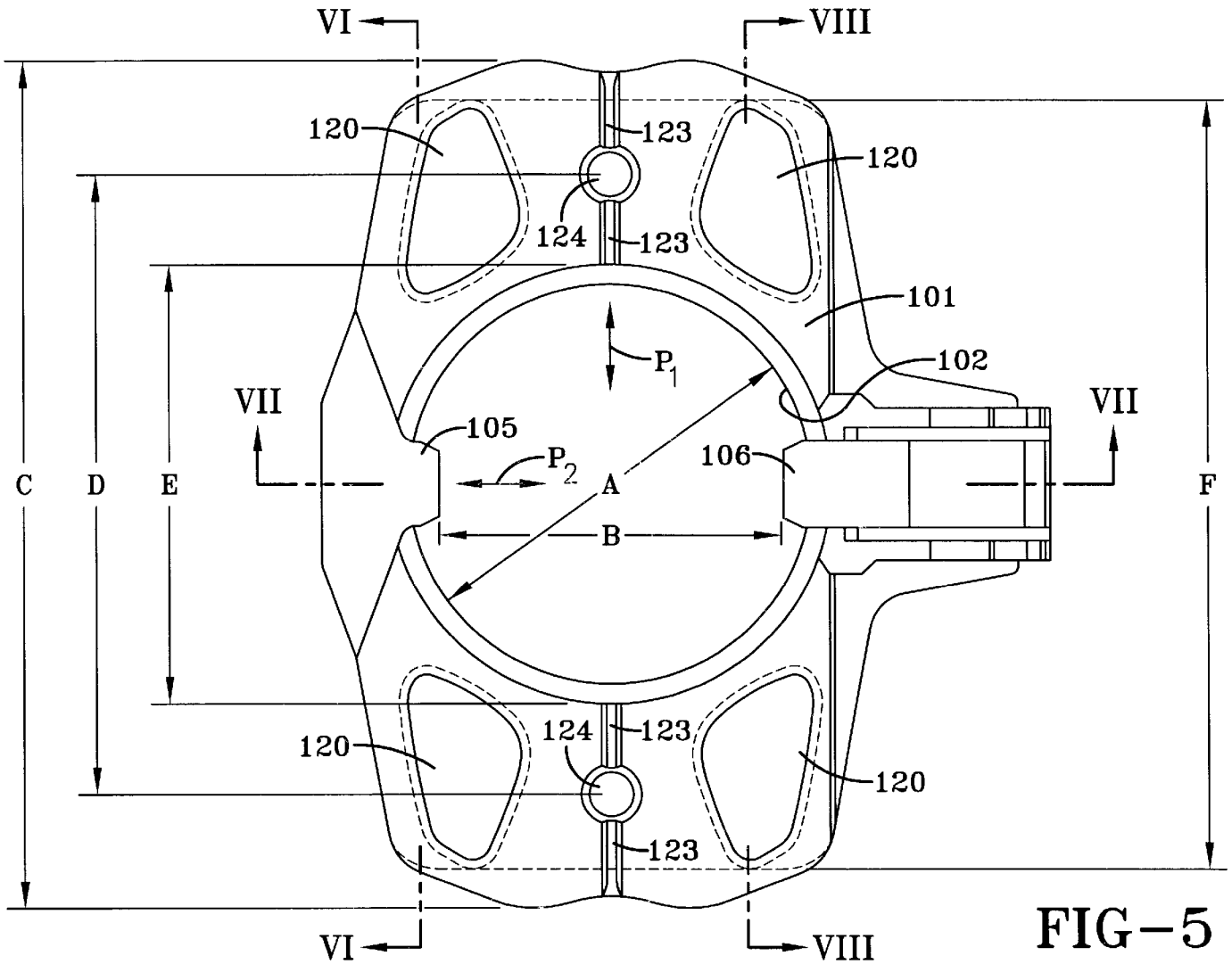
FIG. 5 shows a plan view of a further binding according to the invention.
Figure 6:
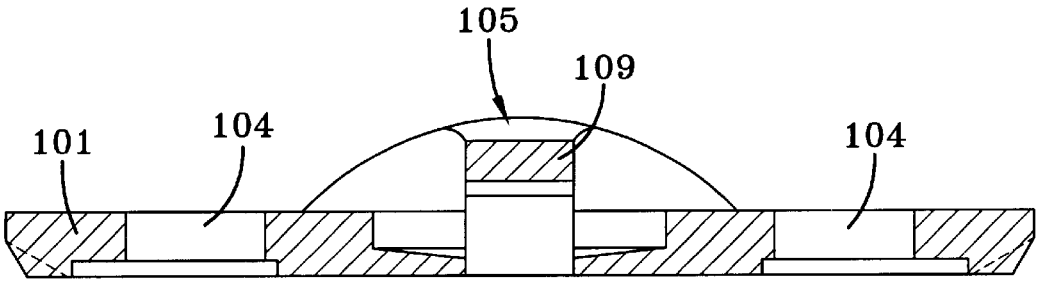
FIG. 6 shows a longitudinal section along the section line VI—VI in FIG. 5.

In the embodiment of FIG. 5, the binding has a standing plate 101 for receiving a snowboard boot (not shown), which can be fastened on the upper side of a snowboard or the like (not shown). For this purpose, the standing or foot plate 101 has a large central circular opening 102 which can be covered over by means of a flange plate (not shown) which overlaps the edges of the circular opening 102 and can be screwed to the snowboard or the like and, in this arrangement, holds the foot plate 101 under stress against the upper side of the snowboard. In this arrangement, the flange plate is secured in a non-rotatable manner on the snowboard or the like by means of a plurality of screws and engages, by means of a radial corrugation on the underside of the edge region, into a mating corrugation on the upper side of the edge region of the central circular opening 2, with the result that the foot plate 101 is secured, on the one hand, in a frictionally locking manner on account of the bracing between the flange plate and snowboard or the like and, on the other hand, also in a positively locking manner due to the corrugations engaging one inside the other.

In order to secure a boot positioned on the foot plate 101, use is made of a stationary boot-retaining device 105 and of a movable boot-retaining device 106, which interact, in a manner outlined below, with side parts arranged on the longitudinal edges of the sole. When the snowboard boot is positioned on the foot plate 101, the movable boot-retaining device 106 is pressed down into a clamped-in position from a self-retaining release position, as is likewise explained below.

Figure 12:
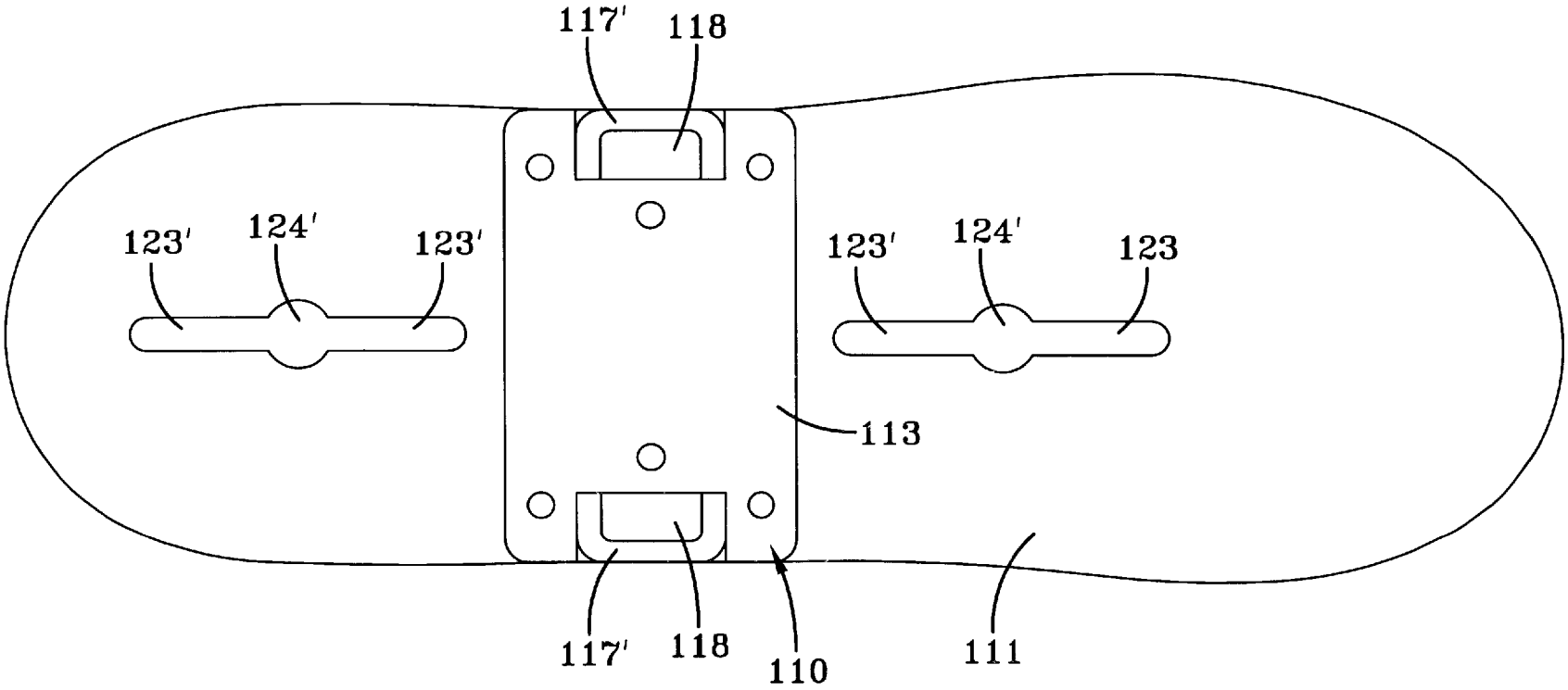
FIG. 12 shows a bottom view of the boot sole.

According to FIG. 12, a rigid fitted piece 110 is arranged in a central region of the boot sole 111, between the heel and the ball of the foot, and is fixed to the rest of the sole in basically any manner. According to a preferred embodiment of the invention, the fitted piece 110 is embedded in the boot sole 111.

Figure 9:
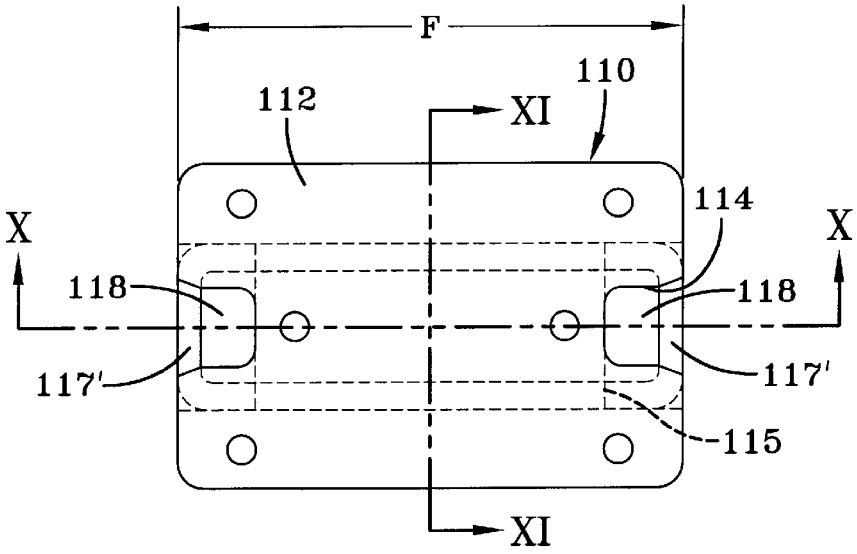
FIG. 9 shows a plan view of a fitted piece of a boot.
Figure 10:
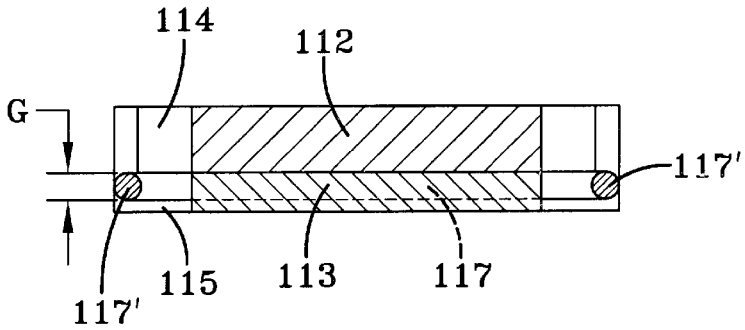
FIG. 10 shows a cross section of the fitted piece along the section line X—X n FIG. 9.
Figure 11:
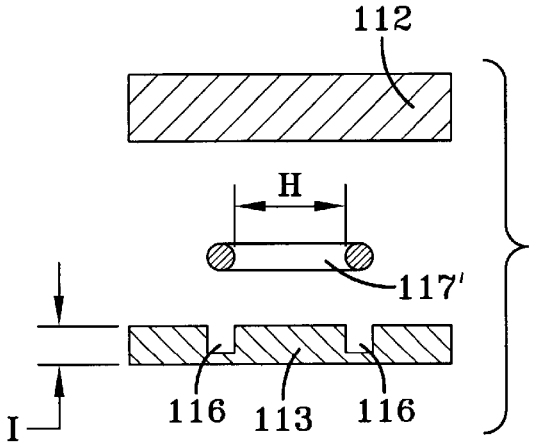
FIG. 11 shows a section of a dismantled fitted piece along the section line XI—XI in FIG. 9.

According to FIGS. 9 to 11, the fitted piece 110 essentially comprises two plates 112 and 113 which are fixed to each other, and each has an essentially rectangular shape. On the narrow sides of plates 112 and 113, central recesses 114 and 115 are open towards the outside. According to FIG. 9, these recesses 114 and 115 are of the same depth, but the recesses 115 of the lower plate 113 are of a greater width than the recesses 114 of the upper plate 112. Arranged on that side of the lower plate 113 which faces the upper plate 112 are two parallel grooves 116 whose respectively outer flanks are spaced apart from one another by a distance corresponding to the width of the recesses 115. The grooves 116 receive the longitudinal parts of a rectangular frame 117, whose frame members have a circular cross section. The frame 117 is arranged such that those sides of its shorter frame members which are directed away from one another are in alignment with the corresponding outsides of the lower plate 113. Since the plates 112 and 113 are riveted firmly to one another, the frame 117 is clamped in between the plates 112 and 113 in a fixed and captive manner.

Frame 117 has engagement members such as web regions 117' which are exposed in the recesses 114 and 115 of the plates 112 and 113, and together with the edges of the recesses 114 and 115 form large-surface-area openings 118 through which a layer of snow or ice which may be adhering above the web regions 117' can easily be pressed or forced downward.

The upper side of the web regions 117' is at a somewhat lower level than the upper side of the longitudinal edge of the boot sole.

Figure 7:
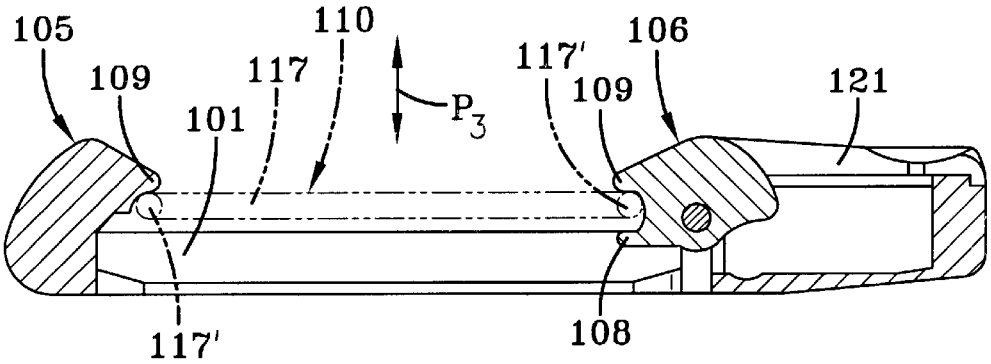
FIG. 7 shows a cross-sectional detail along the section line VII—VII in FIG. 5.
Figure 8:
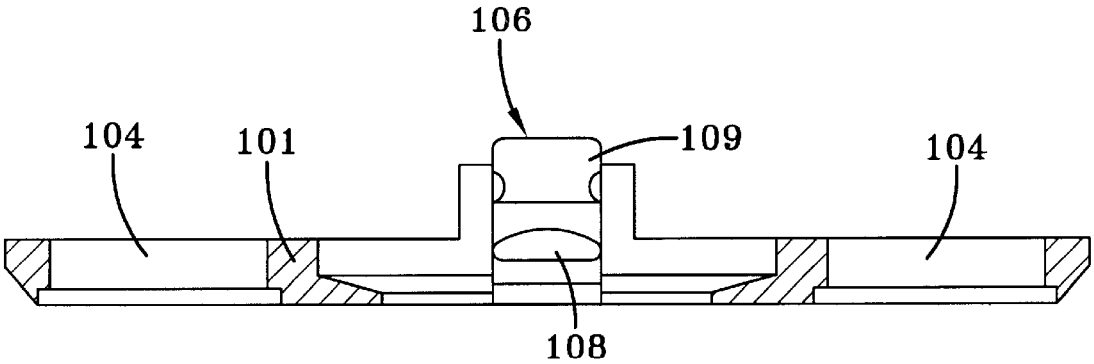
FIG. 8 shows a longitudinal section along the section line VIII—VIII in FIG. 5.

It can be seen from FIG. 7 how the boot-retaining devices 105 and 106 interact with the fitted piece 110.

With the boot locked in the binding, the boot-retaining devices 105 and 106 each engage over the web regions 117' of the frame 117 from above by means of a lug 109, which is shaped in each case such that it also rests against the outside of each of the web regions 117', the outsides of the web regions being directed away from one another. Moreover, the lugs 109 have a shape, in plan view of FIG. 5, which is adapted to the shape of the recesses 114 of the plate 112 of the fitted piece 110.

As a result, due to the positively locking connection with the boot-retaining devices 105 and 106 or the lugs 109 thereof, the fitted piece 1100 is thus secured both in the longitudinal direction and in the transverse direction of the binding, i.e. in the direction of the double arrows $P_1$ and $P_2$ in FIG. 5. A vertical movement, i.e. a movement in the direction of double arrow $P_3$ in FIG. 7 is prevented in the upward direction by the interaction of the web regions 117' with the lugs 109 of the boot-retaining devices 105 and 106. In the downward direction, it is not possible for any movement to occur because the fitted piece 110 is supported by means of the boot sole 111, on the foot plate 101 or on cushion-like supporting elements 120, which are secured in openings 104 of the foot plate 101 in a captive or exchangeable manner.

In order to be able to remove the boot from the binding, the movable boot-retaining device 106 is adjusted in the clockwise direction, by means of a handle 121, into a relief position from the clamped-in position represented in FIG. 7, with the result that the boot, with the fitted piece 110, can be lifted upward out of the region of the boot-retaining devices 105 and 106.

When the boot is introduced into the binding, the movable boot-retaining device 106 is initially in its release position. The boot, with the fitted piece 110, is then introduced between the boot-retaining devices 105 and 106 such that the fitted piece 110 assumes a position, by means of one web region 117', beneath lug 109 of the fixed boot-retaining device 105. When the boot is then pressed down, the web region 117' on that side of the fitted piece 110 which faces the movable boot-retaining device 106 into the locked position represented in FIG. 7, with the result that the fitted piece 110 once again assumes the clamped-in position represented there. The binding is thus, once again, configured as a so-called step-in binding.

The introduction of the boot into the binding can be facilitated if the tread surface of the tread spur 108 is of a convex design, because in this case the tread spur can also be pressed down particularly easily when the boot is introduced into the binding with the toe of the boot inclined obliquely downward or the heel of the boot inclined obliquely downward.

On account of the fitted piece 110 having a shape which is symmetrical with respect to its longitudinal axis and transverse axis, the boot can be introduced into the binding, i.e. locked with the boot-retaining devices 105 and 106, in mutually opposite directions.

The boot sole 111 may be comparatively flexible in front of and behind the fitted piece 110. If a boot were then to be locked in the positively locking manner with the binding merely via the fitted piece 110, this would nevertheless achieve a very high degree of compliance, in particular in the case of torques with respect to the axis of the tibia.

According to a preferred embodiment of the invention, tactile locating means such as longitudinal webs 123 and/or stud-like protrusions 124 with a preferably relatively large cross section may thus be arranged on the standing plate 101 and interact with mating cutouts or tactile locating means 123' and 124' on the underside of the boot sole 111. These longitudinal webs 123 and protrusions 124 are, once again, arranged symmetrically with respect to the longitudinal axis and transverse axis of the binding, such that the boot can be introduced into the binding in mutually opposite directions, i.e. in the forward direction and backward direction.

The above-mentioned supporting elements 120 are also correspondingly arranged in a symmetrical manner, with the result that the boot sole is supported in a similar fashion both when the boot is clamped in in the forward direction and when it is clamped in in the backward direction.

As explained below, the dimensions identified by the letters A–I in FIGS. 5 and 9–11 have been shown to be particularly advantageous for snowboard bindings: A=98.5 mm; B=84 mm; C=208 mm; D=152 mm; E=108 mm; F=94.63 mm; G=7.3 mm; H=22 mm; and I=5 mm.

In the width direction of the boot, the fitted piece 110 preferably has a dimension F of from 90 to 100 mm, preferably of 94.63 mm. This ensures, for any boot size (for adults), that the boot sole need not be of an excessively wide or excessively narrow design. The spacing B of the lugs 109 of the boot-retaining devices 105 and 106 from one another, with the boot-retaining device 106 located in the locked position is smaller by approximately 10mm than the dimension F of the fitted piece 110 in the width direction of the boot, with the result that said lugs 109 can overlap the fitted piece reliably in all circumstances. The spacing B of the lugs 109 is preferably around 84 mm.

The longitudinal spacing D of the protrusions 124 on the foot plate 101 is likewise dimensioned such that, in the case of different boot lengths, the boot sole is latched on the foot plate 101 in a satisfactory manner. In this arrangement, this dimension is preferably somewhat smaller than double the spacing of the lugs 109 from one another. In a particularly preferred embodiment, the spacing D—as measured from center to center of the protrusions 124—is around 152 mm.

Relatively large free spaces are intended to be formed in the binding, beneath the lugs 109 of the boot-retaining devices 105 and 106 and beneath the tread spur 108 of the boot-retaining device 106. This effectively prevents a hard-packed layer of snow or ice adhering to the boot or the boot sole from being able to obstruct the introduction of the boot into the binding. Rather, the snow or the ice is forced away into the free spaces during the introduction of the boot.

The boot-retaining device 106 is preferably designed such that it can also be pressed down into a lockable position when snow or ice is adhering to the underside of the boot sole 111. A relatively large so-called snow spanning height is thus achieved. When the snow or the ice melts, the boot-retaining device 106 is automatically and actively readjusted by a spring mechanism until it reaches an end position or an over dead center position with respect to the spring mechanism when the snow or ice has completely melted.

Figure 13:
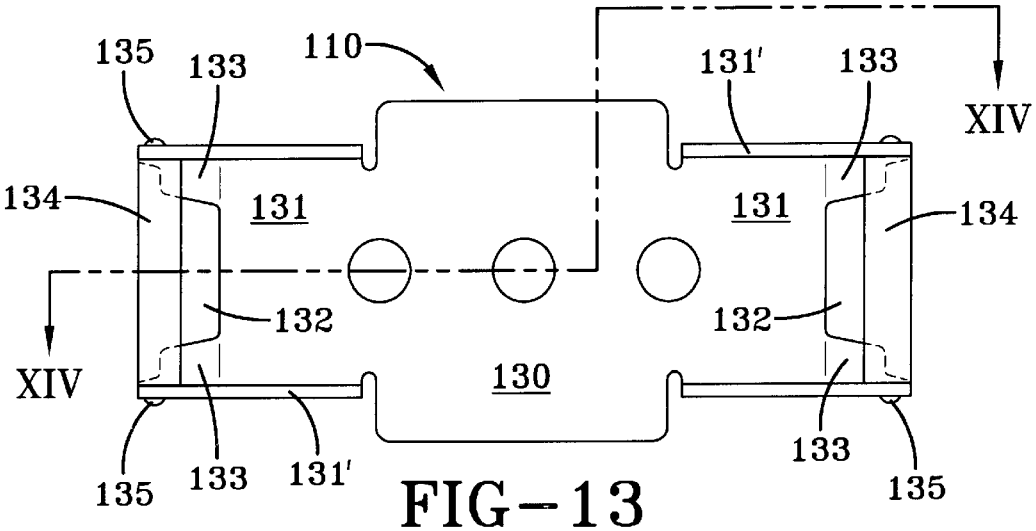
FIG. 13 shows a plan view of the underside of a second embodiment of the fitted piece.
Figure 14:
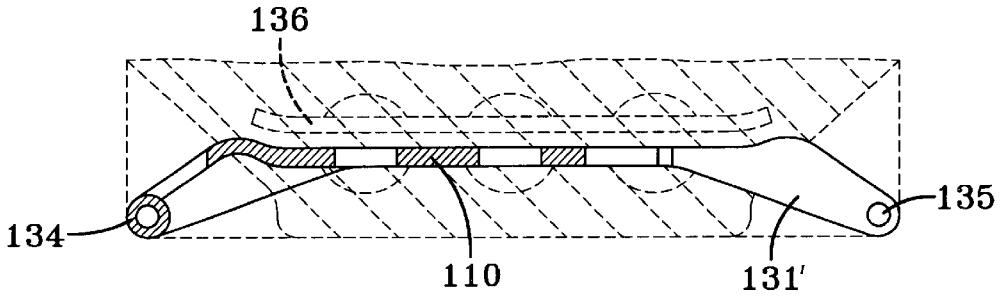
FIG. 14 shows a partial section of said fitted piece along the section line XIV—XIV in FIG. 13.

The fitted piece 110 represented in FIGS. 13 and 14 is designed as a punched sheet metal part. This has a plate-like central region 130 which is adjoined by lateral continuations 131 with borders 131' in the form of angle profiles. These continuations 131 are provided, at their ends remote from the central region 130, with recesses 132, such that fork-like end pieces 133 (FIGS. 10, 11) are formed. Arranged between the end pieces 133 of each continuation 131 are engagement members such as roller-like cross members or frame members 134 which are accommodated, for example, by means of pin-like ends or journals in bores on the flanks of the end pieces 133 and are secured by welds 135. If appropriate, a rotatable arrangement of the roller-like members 134 is also possible.

In the arrangement of the fitted piece 110 of FIGS. 13 and 14 on the boot, the cross members 134 are located some way beneath the plane of the central region 130, the members 134 assuming a position in which they are approximately in alignment with the respective longitudinal edge of the boot sole.

In FIG. 14, the boot-sole region in which the fitted piece 110 is embedded is shown by broken lines. For fixed anchorage in the sole region, the fitted piece 110 may be connected, e.g. riveted, to a plate 136 on its upper side, it being possible for structured parts of the sole region, for example a foot shell part embedded in the sole region, to be clamped in between the upper side of the fitted piece 110 and the facing underside of the plate 136.

Figure 15A:
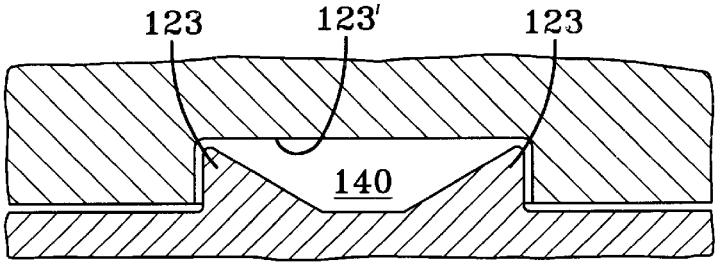
FIG. 15 shows a section of boot sole and standing plate of the binding in the region of interacting protrusions and cutouts.
Figure 15B:
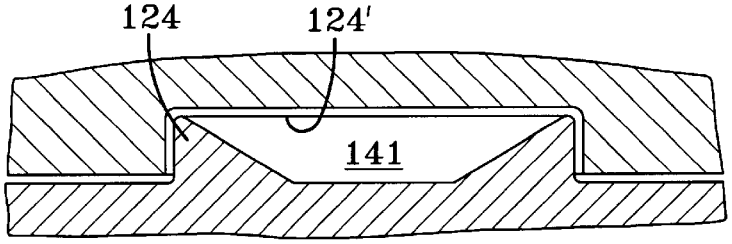

FIG. 15A shows a specific design of the longitudinal protrusion 123, which is arranged on the standing plate 101 of the binding and interact with the cutout 123' in the boot sole. FIG. 15B shows the design of the protrusion 124, which interacts with the cutout 124' on the sole, represented in more detail.

Protrusions 123 form a double-protrusion arrangement, those sides of the protrusions 123 which are directed away from one another being designed as steep flanks, while the mutually-facing sides of the protrusions 123 are designed as slanted flanks. The cutout 123' on the sole is designed such that it can interact in a positively-locking manner only with the above-mentioned steep outer flanks of the protrusions 123, and a free space 140 remains between the two protrusions 123. If, when the boot is introduced into the binding, snow should adhere to the underside of the sole in the region of the cutout 123', the snow can be displaced into free space 140 when the boot is positioned on the foot plate 101, with the result that, despite the snow, the protrusions 123 can be brought into positively-locking engagement with the cutout 123'.

According to FIG. 15B, the protrusion 124, which is circular in plan view, comprises an annular upstanding portion with a steep outside and a slanted flat inside, while the associated cutout 124' on the sole is designed as an essentially cup-like depression, with the result that a free space 141 remains within the annular portion of the protrusion 124, and snow which adheres in the region of the cutout 124' can be pressed into this free space when the boot is positioned on the standing plate 101.

If appropriate, two stud-like protrusions may also be spaced apart one beside the other on the standing plate and interact in a positive-locking manner with a depression which is located in the sole and is in the shape of a slot in plan view, a free space for receiving snow remaining between the stud-like protrusions.

The invention has been described in detail, with particular emphasis being placed on the preferred embodiments thereof, but variations and modifications thereof within the spirit and scope of the invention may occur to those skilled in the art from the foregoing description and from the appended claims.

What is claimed is:

1. A binding for a snowboard and a boot sole for cooperating with said binding for releasable attachment to the snowboard; said boot sole having a longitudinal axis, longitudinal sides on opposite sides of the longitudinal axis and a transverse axis, said sole being attachable to a boot having a central region, wherein:

said boot sole comprises side engagement members proximate said opposite sides, said side engagement members being engagable to positively hold said sole in a fixed location; and said binding comprises boot-retaining means for engaging said side engagement members of said boot sole symmetrically with respect to the longitudinal and transverse axes of said boot sole, said boot sole being attachable to said binding on opposite sides of said longitudinal axis, said boot-retaining means assuming a latching condition for engaging said side engagement members of said boot sole at the central region of the boot, from a release condition when said boot sole is inserted into said binding, and said boot-retaining means being actuable for causing said boot-retaining means to assume the latching condition from the release condition, wherein said binding farther comprises a base plate and a stationary part stationary relative to said base plate, and said boot-retaining means comprises a first boot-retaining member and a second boot-retaining member, said second boot-retaining member being movable between the latching condition and the release condition relative to said stationary part, and said second boot-retaining member includes cable pull means extending between said second boot-retaining member and said base plate, said cable pull means comprising a cable connected to said stationary part and said second boot-retaining member and being actuable for causing said second boot-retaining member to assume the release condition from the latching condition wherein said cable pull means comprises a grip piece for actuating said cable and having a reel biased to take up any excess cable to prevent the occurrence of any slack cable.

2. The invention according to claim 1 wherein said binding further comprises support members extending upwardly at an angle from said base plate at the front and rear portions of said base plate for supporting the front and rear portions of said sole above said base plate.

3. The invention according to claim 1 wherein said boot sole further comprises an underside having engagement means, and said base plate comprises locating means having a configuration for mating with said engagement means of said boot sole for preventing movement of said boot sole relative to said base plate.

4. A binding for a snowboard and a boot sole for cooperating with said binding for releasable attachment to the snowboard; said boot sole having a longitudinal axis, longitudinal sides on opposite sides of the longitudinal axis, a transverse axis, a front region, a central region, a rear region, and an underside, said sole being attachable to a boot having a central region, wherein:

said boot sole comprises side engagement members proximate said opposite sides, said side engagement members being engageable to positively hold said sole in a fixed location; and said binding comprises boot-retaining apparatus for engaging said side engagement members of said boot sole symmetrically with respect to the longitudinal and transverse axes of said boot sole, said boot sole being attachable to said binding on opposite sides of said longitudinal axis, said boot-retaining apparatus assuming a latching condition for engaging said side engagement members of said boot sole at the central region of the boot, from a release condition when said boot sole is inserted into said binding, and said boot-retaining apparatus being actuable for causing said boot-retaining apparatus to assume the latching condition from the release condition;

said boot sole further comprising a fitted piece having said side engagement members engageable by said boot-retaining apparatus for retaining said sole in said binding, said side engagement members being located underneath said underside of said boot sole and extending to said sides of said boot sole, and said fitted piece comprises a sheet metal part having a central region for attaching to said boot sole and end pieces extending from said central region toward said sides of said boot sole, said end pieces having a first and a second outer prong each extending to a side of said boot sole, and cross members extending in the longitudinal direction one across each of said first and second outer prongs, said cross members including said side engagement members.

5. The invention according to claim 4 wherein said boot-retaining apparatus comprises a base plate, a first boot-retaining member which is stationary relative to said base plate on one side of said base plate, and a second boot-retaining member on the other side of said bse plate. and is rotatable between the latching condition and the release condition; said first boot-retaining member and said second boot-retaining member operatively frictionally engaging said side engagement members of said boot sole to positively hold said boot sole in said binding when said second boot-retaining member is in the latching condition.

6. The invention according to claim 4 wherein said boot-retaining apparatus comprises a first boot-retaining member and a second boot-retaining member, said second boot-retaining member being movable between the latching condition and the release condition, the second boot-retaining member comprising spur structure engageable by said bot sole for causing said second boot-retaining member to assume the latching condition from the release condition.

7. The invention according to claim 4 wherein said fitted piece comprises part of an attachment to a boot to form a component of said sole.

8. The invention according to claim 4 wherein said fitted piece has a generally rectangular configuration with laterally extending continuations with opposite pairs of laterally extending fork-shaped end pieces, and said cross members extending in the longitudinal direction across said end pieces and underneath the sides of said sole, said cross members and said end pieces cooperating with said boot sole to define at least one space with said cross members, and said boot retaining apparatus forcing snow adhered near said space into said space.

9. The invention according to claim 4 wherein said fitted piece has frame members and a central portion defining openings on opposite sides of said fitted piece, and said boot-retaining apparatus enters said openings while engaging said side engagement members.

10. The invention according to claim 4 wherein said cross members comprise rollers about an axis extending in the longitudinal direction.

11. the invention according to claim 4 wherein said cross members are fixed against rotation.

12. The invention according to claim 4, wherein said binding further comprises a base plate, said base plate comprising a front portion, a central portion, a rear portion, and locating structure having a configuration for mating with said side engagement members of said boot sole for preventing movement of said boot sole relative to said base plate.

13. The invention according to claim 12 wherein said engagement members and said locating structure define a free space at the central portion of said boot sole and the central portion of said base plate, when said side engagement members and said locating structure are in a mating condition for receiving snow adhering to said sole or said locating members.

14. The invention according to claim 13 wherein said free space at the central portion of the boot sole and the central portion of the base plate is an annular portion.

15. The invention according to claim 13 wherein said locating structure includes at least at least one generally steep flank surface along the transverse axis and at least one generally slanted surface along the longitudinal axis.

16. The invention according to claim 4, wherein said binding further comprises a base plate having a front region and a rear region, and support members extending upwardly at an angle from said base plate at the front and rear region of said base plate for supporting the front and rear regions of said boot sole above said base plate.

17. The invention according to claim 4 wherein said underside of said boot sole has engagement apparatus, and said binding further comprises a base plate, said comprises locating structure having a configuration for mating with said engagement apparatus of said boot sole for preventing movement of said boot sole relative to said boot plate.

18. A binding for a snowboard and a boot sole for cooperating with said binding for releasably holding said boot sole in said binding, wherein:

said boot sole comprises a longitudinal axis, longitudinal sides on opposite sides of the longitudinal axis, side engagement members on opposite sides of said longitudinal axis and receiving structure; and said binding comprises a base plate, boot-retaining apparatus connected to said base plate for engaging said side engagement members for releasably holding said boot sole in said binding, and protrusion structure extending from said base plate and being receivable in said receiving structure, said receiving structure cooperating with said protrusion structure for preventing rotation of said boot sole about an axis transverse to said base plate and said receiving structure being located between the longitudinal axis and a longitudinal side of the boot sole, wherein said protrusion structure comprises at least one longitudinal rib having opposite sides, one of said sides being perpendicular to said base plate and the opposite side being slanted to converge with said one side.

19. A binding for a snowboard and a boot sole for cooperating with said binding for releasably holding said boot sole in said binding, wherein:

said boot sole comprises a longitudinal axis, longitudinal sides on opposite sides of the longitudinal axis, side engagement members on opposite sides of said longitudinal axis and receiving structure; and said binding comprises a base plate, boot-retaining apparatus connected to said base plate for engaging said side engagement members for releasably holding said boot sole in said binding, and protrusion structure extending from said base plate and being receivable in said receiving structure, said receiving structure cooperating with said protrusion structure for preventing rotation of said boot sole about and axis transverse to said base plate and said receiving structure being located between the longitudinal axis and longitudinal side of the boot sole, wherein said protrusion structure comprises a longitudinal rib having an abutting surface transverse to the longitudinal direction of said rib, and said receiving structure comprises an engaging surface for engaging surface for engaging said abutting surface to limit the longitudinal movement of said boot sole relative to said base plate.

20. The invention according to claim 19 wherein said abutting surface comprises a cylinder having a cylindrical axis transverse to the longitudinal direction of said base plate.

21. A binding for a snowboard and a boot sole for cooperating with said binding for releasably holding said boot sole in said binding, wherein:

said boot sole comprises a longitudinal axis, longitudinal sides on opposite sides of longitudinal axis, side engagement members on opposite sides of said longitudinal axis and receiving structure; and said binding comprises a base plate, boot-retaining apparatus connected to said base plate for engaging said side engagement members for releasably holding said boot sole in said binding, and protrusion structure extending from said base plate and being receivable in said structure, said receiving structure cooperating with said protrusion structure for preventing rotation of said boot sole about an axis transverse to said base plate and said receiving structure being located between the longitudinal axis and a longitudinal side of the boot sole, wherein said protrusion structure comprises inflexible protrusions located on the longitudinal axis of the base plate.

22. A binding for a snowboard and a boot sole for cooperating with said binding for releasably holding said boot sole in said binding, wherein:

said boot sole comprises a longitudinal axis, longitudinal sides on opposite sides of the longitudinal axis, side engagement members on opposite sides of said longitudinal axis and receiving structure; and said binding comprises a base plate, boot-retaining apparatus connected to said base plate for engaging said side engagement members for releasably holding said boot sole in said binding, and protrusion structure extending from said base plate and being receivable in said receiving structure, said receiving structure cooperating with said protrusion structure for preventing rotation of said boot sole about an axis transverse to said base plate and said receiving structure being located between the longitudinal axis and a longitudinal side of the boot sole, wherein said protrusion structure comprise two pairs of opposing longitudinal ribs, each pair having a longitudinal rib on opposite sides of the longitudinal axis, and wherein said receiving means comprises two pairs of slots in said boot sole for receiving the respective longitudinal ribs.

23. A binding for a snowboard and a boot sole for cooperating with said binding for releasable attachment to the snowboard; said boot sole having a longitudinal axis, longitudinal sides on opposite sides of the longitudinal axis and a transverse axis, said sole being attachable to a boot having a central region, wherein:

said boot sole comprises side engagement members proximate said opposite sides, said side engagement members being engageable to positively hold said sole in a fixed location; and said binding comprises boot-retaining apparatus for engaging said side engagement members of said boot sole, said boot sole being attachable to said binding on opposite sides of said longitudinal axis, said boot-retaining apparatus assuming a latching condition for engaging said side engagement members of said boot sole at the central region of the boot sole, from a release condition when said boot sole is inserted into said binding, and said boot-retaining apparatus being actuable for causing said boot-retaining apparatus to assume the latching condition from the release condition, wherein said binding further comprises a base plate and a stationary part stationary relative to said base plate, and said boot retaining apparatus comprising a first boot-retaining member and a second boot-retaining member, said second boot-retaining member being movable between the latching condition and the release condition relative to said stationary part, and said second boot-retaining member includes a cable pull device extending between said second boot-retaining member and said base plate, said cable pull device comprising a cable connected to said stationary part and said second boot-retaining member and being actuable for causing said second boot-retaining member to assume the release condition from the latching condition wherein said cable pull device comprises a grip piece for actuating said cable and having a reel biased to take up any excess cable to prevent the occurrence of any slack cable.

24. A binding for a snowboard and a boot sole for cooperating with said binding for releasable attachment to the snowboard; said boot sole having a longitudinal axis, longitudinal sides on opposite sides of the longitudinal axis, a transverse axis, a front region, a central region, a rear region, and an underside, said sole being attachable to a boot having a central region, wherein:

said boot sole comprises side engagement members proximate said opposite sides, said side engagement members being engageable to positively hold said sole in a fixed location; and said binding comprises boot-retaining apparatus for engaging said side engagement members of said boot sole, said boot sole being attachable to said binding on opposite sides of said longitudinal axis, said boot-retaining apparatus assuming a latching condition for engaging said side engagement members of said boot sole at the central region of the boot, from a release condition when said boot sole is inserted into said binding, and said boot-retaining apparatus being actuable for causing said boot-retaining apparatus to assume the latching condition from the release condition;

said boot sole further comprising a fitted piece having said side engagement members engageable by said boot-retaining apparatus for retaining said sole in said binding, said side engagement members being located underneath said underside of said boot sole and extending to said sides of said boot sole, and said fitted piece comprises a sheet metal part having a central region for attaching to said boot sole and end pieces extending from said central region toward said sides of said boot sole, said end pieces having a first and a second outer prong each extending to a side of said boot sole, and cross members extending in the longitudinal direction one across each of said first and second outer prongs, said cross members including said side engagement members.

* * * * *